US005481817A

United States Patent [19]

Parker

[11] Patent Number: 5,481,817

[45] Date of Patent: Jan. 9, 1996

[54] FIREARM SUPPORT

[76] Inventor: Michael A. Parker, 559 Rose Blvd., Nashville, N.C. 27856

[21] Appl. No.: 136,867

[22] Filed: Oct. 18, 1993

[51] Int. Cl.[6] ..... F41A 23/02

[52] U.S. Cl. ..... 248/286.1; 42/94

[58] Field of Search ..... 42/94; 73/167; 89/37.04; 248/231.7, 286; D22/108

[56] References Cited

U.S. PATENT DOCUMENTS

| | | | |
|---|---|---|---|
| D. 203,680 | 2/1966 | Allison | 42/94 |
| 1,233,638 | 7/1917 | Baerman | 42/94 |
| 2,870,683 | 1/1959 | Wilson | 89/40.06 |
| 4,506,466 | 3/1985 | Hall | 42/94 |
| 4,913,391 | 4/1990 | Klipp | 42/94 |
| 4,937,965 | 7/1990 | Narvaez | 42/94 |
| 4,967,497 | 11/1990 | Yakscoe | 42/94 |
| 5,036,613 | 8/1991 | Smith | 42/94 |
| 5,180,874 | 1/1993 | Troncoso | 42/94 |
| 5,347,740 | 9/1994 | Rather et al. | 42/94 |

*Primary Examiner*—Stephen C. Bentley
*Attorney, Agent, or Firm*—David L. Baker; Rhodes & Ascolillo

[57] ABSTRACT

An adjustable firearm support for use in adjusting the sights of a firearm is disclosed. The firearm support includes a substantially horizontally disposed tube having an armrest movably attached to one end thereof and a gun cradle movably attached to an opposite end thereof. A telescopic stand is pivotally and slidably coupled to the tube by a clevis and facilitates providing vertical support for the tube. The stand, in turn, may be releasably clamped to the stationary object. The clevis is rotatably engageable with the tube so as to permit the tube to be rotated in a horizontal plane. The clevis is further pivotal so as to permit the tube to be pivoted in a vertical plane. The firearm support is not limited in its application to adjusting firearm sights but may be set up at a hunting site, and attached to a tree stand or other solid object, for use in providing a steady rest when sighting and firing at game. When not in use, the firearm support is capable of being broken down into a compact and light-weight assembly so as to be easily transported and stored.

8 Claims, 1 Drawing Sheet

FIREARM SUPPORT

BACKGROUND

1. Field of the Invention

The present invention is related to a firearm support and, more particularly, to an adjustable firearm support for use in adjusting the sights of a firearm.

2. Description of Prior Art

The precision of a firearm is largely dependent upon the accuracy of its sights. When checking the sights of a firearm for accuracy and when adjusting the same, it is important that the firearm remain in a relatively fixed position over a succession of shots being fired. Maintaining the firearm in a relatively fixed position minimizes the amount of time required for adjusting the sights and likewise minimizes the amount of ammunition being expended over the course of the sight adjustment.

Firearm supports are well known and have been the subject of many prior patents. For example, U.S. Pat. No. 4,967,497, issued Nov. 6, 1990 to Brian J. Yakscoe, discloses a collapsible and adjustable firearm support having a cradle supported by a telescopic standard. The standard, in turn, is supported by a tripod arrangement. A component of the tripod arrangement is interchangeable with an optional seat. Unlike applicant's instant invention, the firearm support disclosed by Yakscoe is dependent on the standard and tripod for its support.

Another adjustable firearm support having a gun cradle supported by a telescopic tripod is shown and described in U.S. Pat. No. 2,870,683, issued Jan. 7, 1959 to Walter H. Wilson. Similar to the that of the firearm support disclosed above in the Yakscoe patent, the gun cradle described by Wilson is solely supported by the tripod. Analogous to Wilson is the adjustable firearm support disclosed in U.S. Pat. No. 5,036,613, issued Aug. 6, 1991 to Amos C. Smith, who also teaches a gun cradle which is supported by a telescopic tripod. Alternatively, the gun cradle described by Smith is supported by a telescopic monopod.

Another adjustable firearm support having a gun cradle supported by a telescopic monopod is disclosed in U.S. Pat. No. 4,937,965, issued Jul. 3, 1990 to Salvador Narvaez. Narvaez also teaches a cradle supported by a standard which, in turn, is telescopically supported by a chair. Unlike applicant's instant invention, the standard disclosed by Narvaez is limited in its application to either the chair or monopod arrangements shown.

None of the above inventions and patents, taken either singly or in combination, is seen to describe the instant invention as claimed.

SUMMARY OF THE INVENTION

The present invention is an adjustable firearm support for use in adjusting the sights of a firearm. The firearm support includes a substantially horizontally disposed tube having an armrest movably attached to one end thereof and a gun cradle movably attached to an opposite end.

A telescopic stand is pivotally and slidably coupled to the tube by a clevis and facilitates providing vertical support for the tube. The stand, in turn, may be releasably clamped to a stationary object. The clevis is rotatably engageable with the tube so as to permit the tube to be rotated in a horizontal plane. The clevis is further pivotal so as to permit the tube to be pivoted in a vertical plane.

The cradle has a pair of spaced apart prongs forming a fork which extends transversely and upwardly from the tube. The cradle is displaceable along the longitudinal axis of the tube and provides support for the barrel of the firearm. This cradle is releasably clamped to the forward end of the tube by a threaded fastener such as a wing-type screw.

The armrest is a substantially flat plate-like member having an opening passing through one end. The opening is large enough to releasingly receive the tube. Upon a slidable engagement of the tube with the opening in the armrest, the armrest extends transversely relative to the longitudinal axis of the tube. The armrest is clamp able to the rearward end of the tube and is dimensioned and configured to provide sufficient support for the user's arm.

The firearm support is not limited in its application to adjusting firearm sights but may be set up at a hunting site, such as in a tree stand, for use in providing a steady rest when sighting and firing at game. When the firearm support is not in use, it breaks down into a compact and lightweight assembly for easily transporting and storing the same. When being transported, the firearm support may dangle or be suspended from the belt of a user to preserve space in backpacks and the like.

Accordingly, it is an object of the present invention to provide a portable and adjustable firearm support for use in adjusting the sights of a firearm and for use in providing a steady rest when sighting and firing at game.

It is another object that the firearm support be releasably attachable to stationary objects, such as chairs, tree stands, and the like, and that the same not be limited for use with a tripod or the like.

It is another object that the firearm support be adjustable vertically and horizontally.

Still another object is that the firearm support break down into a small and light weight assembly for carrying ease, and that the same be attachable to the belt of a user so as not to take up space in backpacks and the like.

Yet another object is that the firearm support have a gun cradle for supporting the barrel of a firearm, and an armrest for supporting the arm of the user so as to permit the user to easily return the firearm to essentially the same position after each successive shot has been fired.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
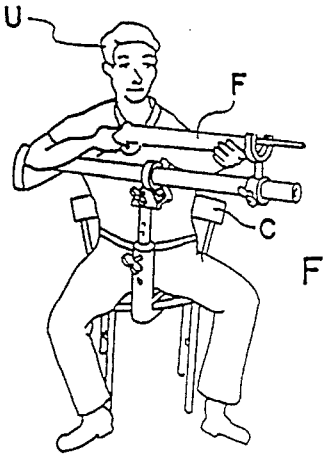
FIG. 1 is an environmental perspective view of an adjustable firearm support according to the present invention.

The present invention, as shown in FIG. 1, is an adjustable firearm support 10 for use in adjusting the sights of a firearm F. The firearm support 10 is removably attachable to a stationary object C, such as the chair shown in the drawing. The firearm support 10 ensures that the firearm F is returned to essentially the same position after each successive shot has been fired. In the absence of the firearm support 10, the position of the firearm F may vary from shot to shot, making it difficult to assess the results of each consecutive sight adjustment. A great deal of ammunition may be expended before the user U feels with reasonable assurance that the firearm sights are accurately adjusted. Through the use of the firearm support 10, the sights of the firearm F may be adjusted in a more timely manner and the amount of ammunition required to adjust the sights may be minimized.

Figure 3:
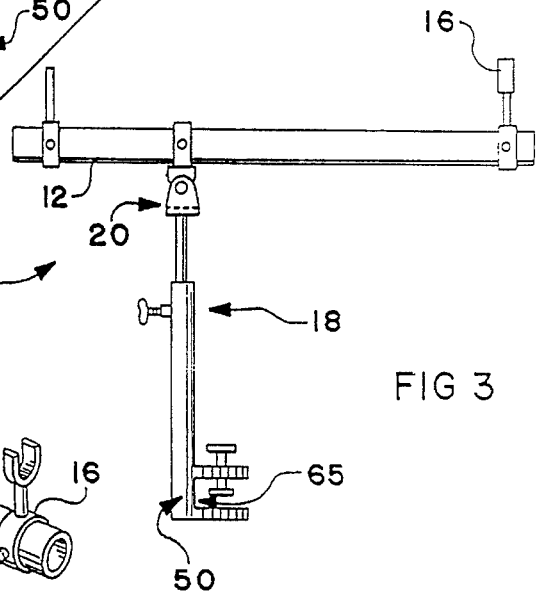
FIG. 3 is a side elevational view of the firearm support.
Figure 2:
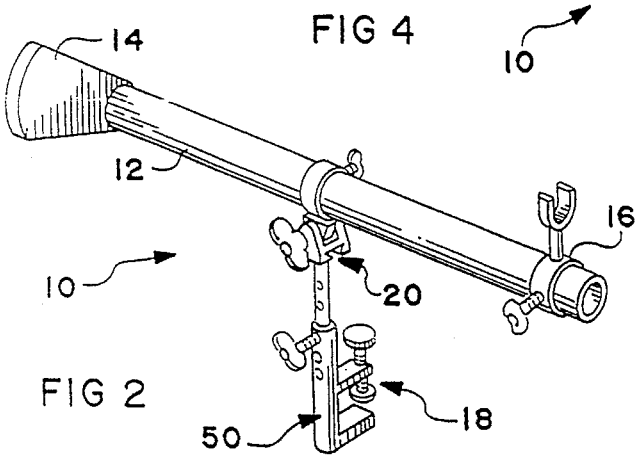
FIG. 2 is a perspective view of the firearm support show in FIG. 1.

Now referring to FIGS. 2 and 3, the firearm support 10 includes a substantially horizontally disposed tube 12 having an armrest 14 movably attached to one end thereof and a gun cradle 16 movably attached to an opposite end. The tube 12 is of sufficient length to accommodate a variety of firearms F. It is preferable that the tube 12 be formed of a lightweight material, such aluminum, and that it be approximately four feet (120 cm) in length.

A telescopic stand 18 is pivotally and slidably coupled to the tube 12 by a clevis 20 and provides vertical support for the tube 12. The stand 18, in turn, may be releasably clamped to the stationary object C, as is shown in FIG. 1.

Figure 4:
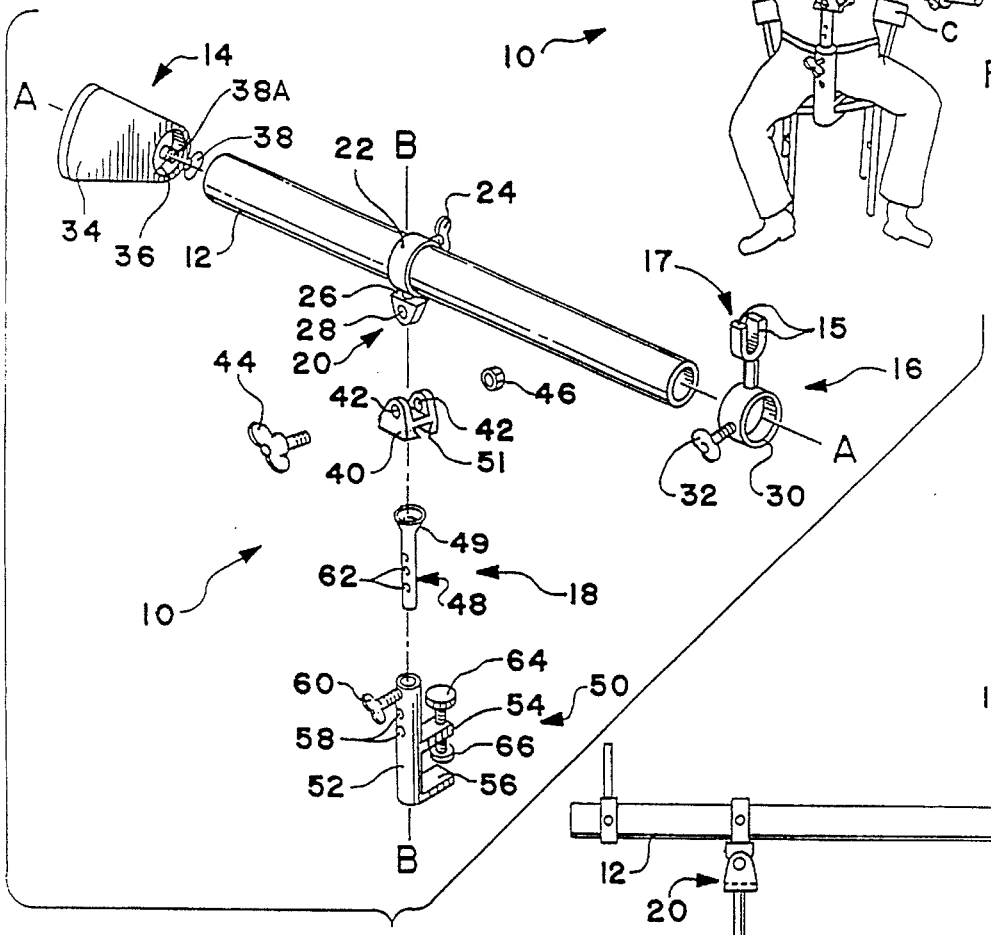
FIG. 4 is an exploded perspective view of the firearm support.

As is illustrated in FIG. 4, a first collar 22 slidably engages the tube 12 and is displaceable along a longitudinal axis A—A. The first collar 22 is dimensioned and configured to releasingly fit over tube 12 and is provided with a threaded aperture (not shown) for receiving a matingly engageable threaded fastener 24, such as the wing-type screw shown. The first collar 22 is clamped by the threaded fastener 24 to the tube 12 near the longitudinal center of the tube. Extending below the first collar 22 is a leg 26 having a hole 28 passing therethrough. The leg 26 releasably engages the first collar 22.

A cradle 16 has a pair of spaced apart prongs 15 forming a fork 17 that extends transversely and upwardly from a second collar 30. This second collar 30 is dimensioned and configured to releasingly receive the tube and is provided with a threaded aperture (not shown) for receiving a matingly engageable threaded fastener 32. The second collar 30 is further slidably engageable with tube 12 so as to be displaceable along the longitudinal axis A—A. This second collar 30 is clamped to a forward end of the tube 12 by the threaded fastener 32 such as a wing type screw as shown in FIG. 2.

The armrest 14 is a substantially flat plate-like member 34 having an opening 36 passing through one end. The opening 36 is large enough to releasingly receive the tube 12. A threaded aperture shown in FIG. 4 with threaded fastener 38 therein is in communication with the opening 36. This threaded aperture 38*a* receive a matingly engageable threaded fastener 38.The armrest 14 slidably receives the tube 12 so as to extend transversely, relative to the longitudinal axis A-A. The armrest 14 is dimensioned and configured to provide sufficient support for the arm of user U (shown in FIG. 1) in an axial direction relative to the tube 12 and is clampable to a rearward end of the tube 12.

A jaw 40 is affixed to the upper end of the stand 18 and has a hole 42 passing through each one of the members of jaw 40. The jaw 40 operatively receives the leg 26 such that the holes 42 passing through the jaw 40 mutually align with the hole 28 in the leg 26. A threaded fastener 44 is insertable into and through the mutually aligned holes 42, 28 and cooperatively engages a matingly engageable nut 46 to movably secure the leg 26 to the jaw 40, and thus form the clevis 20. By loosening the threaded fastener 44 slightly, the tube 12 may be rotated up and down in a vertical plane.

A standard 48 has a flange 49 at its upper end which frictionally engages a set of channels 51 at the lower end of the clevis 20. Upon engagement of the flange 49 with the channels 51, the standard 48 extends downward from the lower end of the clevis 20. The lower end of the standard 48, in turn, telescopically engages a clamp 50. The clamp 50 includes a vertically extending tube 52. The verticallly extending tube 52 is dimensioned so as to receive the standard 48 and includes a plurality of threaded apertures 58 therein, successively arranged parallel to the longitudinal axis B-B thereof. A threaded fastener 60, such as the wing-type screw shown, is selectively and matingly engageable with the threaded apertures 58. The standard 48 includes a plurality of holes 62 therein, successively arranged parallel to the longitudinal axis B—B. Upon tightening the threaded fastener 60 into one of the threaded apertures 58, the user selectively places the threaded fastener 60 into same one of the holes 62 in the standard 48 to fix the elevation of the standard and to prevent the standard 48 from inadvertently rotating relative to the vertically extending tube 52. The lower end of the vertically extending tube 52 has spaced apart upper and lower projecting members 54, 56 extending radially from the bottom end thereof so as to form a clamp jaw 65. The uppermost projecting member 54 has a threaded aperture passing therethrough that is configured to receive a threaded member 64, such as the thumb screw shown. The end of the threaded member 64 is provided with a pad 66 which engages the stationary object C to which it is being secured to reduce the risk of damage thereto. As is evident in FIG. 1, the stationary object C is received between the jaws or the spaced apart projecting members 54, 56 and is secured therebetween by tightening the threaded member 64.

The firearm support 10 is shown secured to the stationary object C by the clamp 50, and the tube 12 is fixed in a substantially horizontal plane by tightening the threaded fastener 44 which, in turn, locks the clevis 20. The barrel of the firearm F is supported by the gun cradle 16 and the stock thereof extends rearwardly alongside the tube 12 opposite the armrest 14. With the user U situated such that his or her arm is draped over the tube 12 and supported by the armrest 14, a shot is fired at a stationary target (not shown) to check the sight for accuracy. If necessary, the sight may be adjusted and the same position may be resumed by the user U, thus returning the firearm F to the same position. This process is repeated until the sights are accurately adjusted. To compensate for windage and the like, the clevis 20 is free to rotate in the horizontal plane on the telescopic stand 18 when threaded fastener 44 is disengaged.

It should be noted that the firearm support 10 is not limited in its application to adjusting firearm sights, but may be set up at a hunting site for use in providing a steady rest when sighting and firing at game. When the firearm support 10 is not in use, the same breaks down into a compact and lightweight assembly so as to be easily transported and stored. When being transported, the firearm support 10 may dangle or be suspended from a belt (not shown) of the user U to preserve space in back packs (also not shown) and the like.

It is to be understood that the present invention is not limited to the sole embodiment described above, but encompasses any and all embodiments within the scope of the following claims.

What is claimed is:

1. A firearm support for use in adjusting a sight of a firearm, said firearm support comprising:

a) an elongated tube having a forward end and a rear end, and defining a longitudinal axis;

b) a first collar releasably engageable with and surrounding said elongated tube, said first collar being slidably displaceable along the longitudinal axis of said elongated tube and having a clevis extending downwardly therefrom, said clevis being selectively rotatable in a horizontal plane;

c) a stand coupled to said elongated tube by said clevis so as to provide vertical support for said elongated tube, said clevis further being selectively pivotable in a vertical plane;

d) a second collar releasably attachable to said forward end of said elongated tube, said second collar being slidably displaceable along the longitudinal axis of said elongated tube and having a pair of prongs extending upwardly therefrom, said pair of prongs forming a fork for supporting a barrel of the firearm;

e) a plate-like member releasably attachable to said rear end of said elongated tube, said plate-like member being slidably displaceable along the longitudinal axis of said elongated tube, said plate-like member combining with said elongated tube to form an armrest for supporting an arm of a user; and f) a clamp having means for telescopically receiving said stand, said clamp being releasably clampable to an object.

2. A firearm support for use in adjusting the a sight of a firearm, said firearm support comprising:

a) an elongated component;

b) a stand coupled to said elongated component so as to provide vertical support for said elongated component;

c) a cradle movably attached to said elongated component forward of said stand, said cradle for supporting a barrel of a firearm;

d) an armrest attachable to said elongated component rearwardly of said stand, said armrest for supporting an arm of a user;

e) means for clamping said stand to an object; and f) said armrest includes a plate-like member for supporting an arm of a user in a direction parallel to said elongated component.

3. A firearm support according to claim 2, further including means for coupling said elongated component to said stand, said coupling means being operable to selectively pivot said elongated component in a vertical plane.

4. A firearm support according to claim 2, further including means for coupling said elongated component to said stand, said coupling means being operable to selectively rotate said elongated component in a horizontal plane.

5. A firearm support according to claim 2, further including means for removably coupling said elongated component to said stand.

6. A firearm support according to claim 2, further including means for movably attaching said armrest to said elongated component.

7. A firearm support according to claim 2, further including means for telescopically engaging said stand with said clamping means.

8. A firearm support according to claim 2, wherein said cradle includes a pair of spaced apart prongs forming a fork for receiving the barrel of the firearm.

* * * * *